US007781023B2

(12) United States Patent
Aldarondo et al.

(10) Patent No.: US 7,781,023 B2
(45) Date of Patent: Aug. 24, 2010

(54) METHOD OF PRODUCING AN ELECTROLUMINESCENT DISPLAY

(75) Inventors: Luis Aldarondo, Corvallis, OR (US); Terry M. Lambright, Corvallis, OR (US); Philip S. Burkum, Corvallis, OR (US); Darrel E. Pozzesi, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 679 days.

(21) Appl. No.: 11/248,928

(22) Filed: Oct. 11, 2005

(65) Prior Publication Data

US 2007/0082123 A1 Apr. 12, 2007

(51) Int. Cl.

| | |
|---|---|
| ***B05D 5/12*** | (2006.01) |
| *B05D 3/06* | (2006.01) |
| *G09F 13/00* | (2006.01) |
| *G09F 13/22* | (2006.01) |
| *H05B 33/00* | (2006.01) |
| *H05B 33/06* | (2006.01) |

(52) U.S. Cl. ..... 427/407.1; 156/58; 257/E51.044; 257/88; 257/98; 427/64; 427/66; 427/596; 428/32.6; 428/690; 428/67; 428/141; 313/506; 313/493; 313/509; 313/510; 313/512; 430/270.11

(58) Field of Classification Search ..... 427/407.1
See application file for complete search history.

(56) References Cited

U.S. PATENT DOCUMENTS

| | | | | |
|---|---|---|---|---|
| 4,066,925 | A | | 1/1978 | Dickson |
| 4,138,620 | A | | 2/1979 | Dickson |
| 5,171,650 | A | | 12/1992 | Ellis et al. |
| 5,516,387 | A | | 5/1996 | Hoffman |
| 5,533,289 | A | | 7/1996 | Hoffman |
| 5,646,481 | A | | 7/1997 | Zovko |
| 5,692,327 | A | * | 12/1997 | Wynne et al. ..... 40/205 |
| 5,962,962 | A | | 10/1999 | Fujita et al. |
| 6,225,740 | B1 | | 5/2001 | Tucker et al. |
| 6,338,892 | B1 | | 1/2002 | McCue et al. |
| 6,424,088 | B1 | | 7/2002 | Murasko |
| 6,501,218 | B1 | | 12/2002 | Duggal et al. |
| 6,566,808 | B1 | | 5/2003 | Duggal et al. |
| 6,727,647 | B2 | | 4/2004 | Fukuda et al. |
| 6,773,614 | B2 | | 8/2004 | Field |

(Continued)

FOREIGN PATENT DOCUMENTS

| | | |
|---|---|---|
| EP | 0773707 | 5/1997 |

(Continued)

OTHER PUBLICATIONS

Transmittal of the International Search Report and the Written Opinion of the International Searching Authority dated Jan. 26, 2007 for PCT/US2006/029991. Submitted by Applicant and in IFW.*

(Continued)

*Primary Examiner*—Michael Kornakov
*Assistant Examiner*—Alexander Weddle

(57) ABSTRACT

A method of producing an electroluminescent display is provided. A medium is obtained from a stream of commerce. The medium is activated to form a pattern such that the medium emits light by electroluminescence according to the pattern in response to electrical energization.

20 Claims, 4 Drawing Sheets

U.S. PATENT DOCUMENTS

| | | | | |
|---|---|---|---|---|
| 6,882,106 | B2 | 4/2005 | Kao | |
| 2002/0142188 | A1 | 10/2002 | Andriash | |
| 2003/0146019 | A1 * | 8/2003 | Hirai | 174/257 |
| 2003/0197461 | A1 | 10/2003 | Fukuda | |
| 2003/0214471 | A1 * | 11/2003 | Topelberg | 345/87 |
| 2004/0029039 | A1 * | 2/2004 | Tutt et al. | 430/270.11 |
| 2004/0043191 | A1 | 3/2004 | Zovko | |

FOREIGN PATENT DOCUMENTS

| | | |
|---|---|---|
| EP | 0866644 | 9/1998 |
| EP | 0966182 | 12/1999 |
| EP | 966182 A1 * | 12/1999 |

OTHER PUBLICATIONS

Transmittal of the International Search Report and the Written Opinion of the International Searching Authority dated Jan. 26, 2007.

"EL—Electroluminescent Lamp," http://www.hkideatech.com/IDT/EL.htm, printed Oct. 11, 2005.

"Advertising Signs," http://electroluminescence-inc.com/advertising_signs.htm, printed Oct. 11, 2005.

* cited by examiner

METHOD OF PRODUCING AN ELECTROLUMINESCENT DISPLAY

BACKGROUND

Electroluminescent displays, such as lighted signs, may be created from electroluminescent panels that emit light from an electroluminescent layer, such as a layer that includes a phosphor. The electroluminescent layer may be disposed within a laminar assembly including a pair of flanking conductive layers separated by a dielectric layer and the phosphor. The conductive layers may function as electrodes, such that application of an alternating current to the electrodes places the phosphor in an alternating electric field, causing the phosphor to emit light by electroluminescence.

An electroluminescent sign may be fabricated to emit light regionally according to the luminescent image to be presented. For example, a conductive material may be applied regionally during fabrication of the sign, to produce a patterned electrode. Upon electrical energization of the patterned electrode (and a spaced partner electrode), a phosphor between the electrodes may be excited regionally to emit a corresponding pattern of electroluminescence.

Fabrication of electroluminescent signs may be costly and/or time-consuming. For example, a conductive and/or luminescent layer of the sign may be formed regionally by patterned application using one or a set of custom-made print screens. This process may be relatively slow and may have a cost per sign that is inversely related to the number of electroluminescent signs produced with the screens. Accordingly, custom electroluminescent signs may be prohibitively expensive to produce in small numbers. Furthermore, the pattern of light emitted by each electroluminescent sign may be difficult to modify after its fabrication.

DETAILED DESCRIPTION

The present teachings provide a system, including method and apparatus, for creation of an electroluminescent display from an activatable medium. In some examples, the medium may be fabricated by a first party, such as a manufacturer, and then introduced into a stream of commerce for acquisition by another party, such as a print shop or an end user. The other party may activate the medium regionally in a pattern, such that medium emits light by electroluminescence upon electrical energization according to the pattern. The medium thus may be supplied as a "blank," which can be activated to display custom luminescent images with customized information content. In some examples, activation may be performed by exposure of the medium to electromagnetic radiation, such as light from a visible or infrared light source, among others. This exposure may alter a physical characteristic of an activatable layer of the medium, for example, increasing the electrical conductivity regionally within the activatable layer.

One or more colorants also may be applied to the medium, for example, by printing onto the medium, at the same time or at a different time relative to activation. The colorants may alter a property, such as the color, intensity, and/or shape, of the luminescent images displayed.

Overall, the system of the present teachings may provide electroluminescent displays with one or more of the following advantages (1) lower cost, (2) faster production, (3) increased ability to be edited or modified, (4) better animation, and/or (5) greater flexibility for customizing each display, among others. Further aspects of the present teachings are presented below including (I) electroluminescent display systems, and (II) examples.

I. Electroluminescent Display Systems

Figure 1:
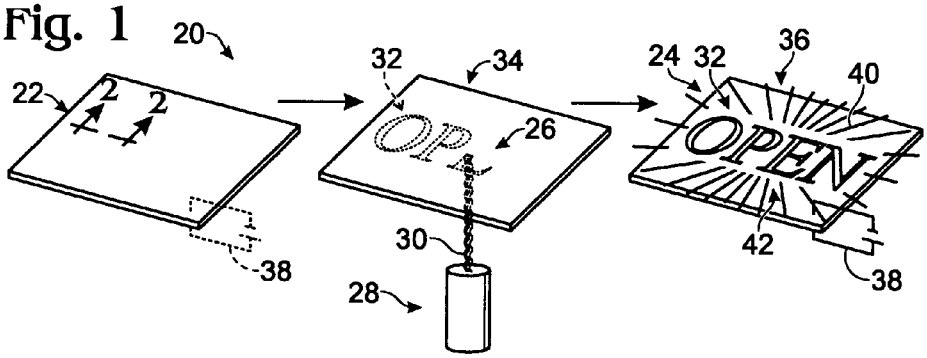
FIG. 1 is a schematic view of an exemplary flowchart illustrating creation of an electroluminescent display by activation of a blank medium, in accordance with aspects of the present teachings.

FIG. 1 shows an exemplary flowchart 20 illustrating activation of a blank medium 22 to create an electroluminescent display 24. The blank medium may be activated, shown at 26 during activation, with an activation mechanism 28, such as a source of electromagnetic radiation 30 (e.g., ultraviolet, visible, and/or infrared light, and/or microwaves, among others). Activation may be in a pattern 32, for example, to form the letters of the word "OPEN" in the present illustration. A pattern, as used herein, may be any suitable shape or shapes extending over any suitable portion of the medium. Accordingly, exemplary patterns may include alphanumeric characters (e.g., words, phrases, numbers, individual letters, etc.);

non-alphanumeric symbols; line drawings; geometric or arbitrary shapes; representations of pictures or other images; and/or the like. Activation may produce a partially activated medium 34 during activation, and a fully activated medium 36 after activation is complete. Energization of activated medium 36 with an electrical power supply 38 (e.g., application of an electric field with a suitably connected alternating current source), may cause the activated medium to electroluminescence (emit light by electroluminescence), shown at 40. Electroluminescence may occur regionally within the activated and energized medium according to the pattern introduced into the medium by activation, to produce a luminescent image 42 (the word "OPEN" in the present illustration).

Blank medium 22 may be at least substantially nonluminescent ("blank") when energized with electrical power supply 38, shown in phantom outline coupled to the blank medium. A blank medium may emit light visibly (with energization) from less than about ten percent of its surface area, less than about one percent of its surface area, or from none of its surface area (as in the present illustration), among others. Alternatively, or in addition, a blank medium may emit light visibly (with energization) at a substantially reduced intensity relative to the intensity produced after activation, for example, less than about ten percent, or less than about one percent of the intensity, among others.

Figure 2:
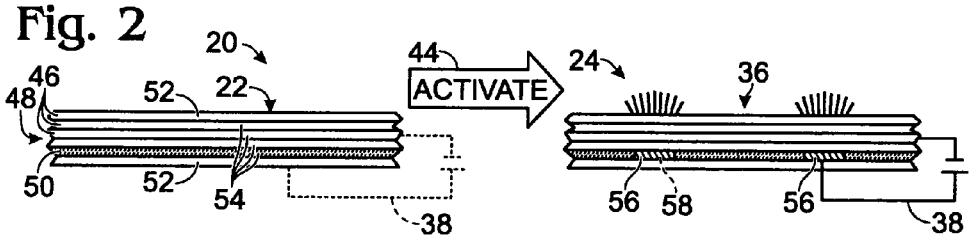
FIG. 2 is a sectional view of selected portions of the flowchart of FIG. 1, taken generally along line 2-2 within the medium of FIG. 1, in accordance with aspects of the present teachings.

FIG. 2 shows selected portions of flowchart 20, particularly before and after activation (indicated by an arrow 44) of medium 22. The medium may include a plurality of layers 46 joined to one another to create a laminar assembly 48. The layers may include an activatable layer (or layers) 50. The activatable layer may be an exterior layer 52 or may be one or more interior layers 54 disposed between the exterior layers. Activation may modify the activatable layer regionally, that is, within a subset of the area of the activatable layer, to create one or more activated regions 56 within the layer.

Activation, as used herein, includes any physical and/or chemical modification of a pre-existing layer(s) of a medium that substantially increases the ability of the medium to electroluminescence in response to electrical energization. Accordingly, activation may be performed without substantially adding material to the medium. In some embodiments, activation may remove a substance, at least partially, from the medium, particularly selective removal of a subset of the components of the activatable layer, such as to concentrate a conductive component of this layer. In any case, activation may alter a physical characteristic, indicated by a dashed line at 58, of the activatable layer. The alteration generally is a sustained alteration in the medium and/or activatable layer that remains after activation has been completed. The physical characteristic may be an intrinsic property of the material forming the activatable layer, that is, a property that can be characterized per unit mass, dimension, area, volume, and/or the like. Exemplary intrinsic properties that may be altered include an electrical property (such as electrical conductivity, resistivity, capacitance, etc.) and/or a luminescent property (such as the ability for, or efficiency of, electroluminescence in the presence of an electric field). Activation also may change the appearance of the medium regionally (in the absence of electrical energization) where the medium is activated, for example, producing a visible change in color regionally within the activatable layer.

Activation of the activatable layer may be performed by any suitable activation treatment(s). The activation treatment may include, for example, regional exposure of the activatable layer to electromagnetic radiation, a chemical reagent, heat, pressure, and/or the like. In some examples, the activation treatment may be performed with a source that emits electromagnetic radiation.

An electromagnetic source or light source, as used herein, generally comprises any mechanism for producing electromagnetic radiation. Exemplary forms of electromagnetic radiation produced by the source may include ultraviolet, visible, and/or infrared light, among others. Exemplary light sources may include continuous wave lasers or pulsed lasers, laser diodes, light-emitting diodes (LEDs), arc (e.g., xenon) lamps, incandescent (e.g., tungsten halogen) lamps, fluorescent lamps, and/or electroluminescent devices, among others. Such light sources may be capable of use in single or multiple illumination modes, including continuous and/or time-varying (e.g., pulsed or sinusoidally varying) modes, among others. Such light sources may produce monochromatic, polychromatic, coherent, incoherent, polarized, and/or unpolarized light, among others. For example, a laser may be used to provide (at least initially) coherent, monochromatic, polarized light.

The light source may be used alone or in combination with various optic elements and/or mechanisms. Exemplary optic elements/mechanisms may include lenses, mirrors, filters, gratings, prisms, and/or the likes. These elements/mechanisms may be used to alter the nature of the light output by the light source (e.g., its color (spectrum or chromaticity), intensity, polarization, and/or coherence, among others). Alternatively, or in addition, these elements/mechanisms may be used to direct and/or alter the size, shape, and/or numerosity of a light beam. The resultant light beam or beams incident on the medium may be diverging, collimated, and/or converging, among others.

The medium may have any suitable size and shape. In some embodiments, the medium may be a sheet medium, that is, a medium having a length and width that are substantially greater than the thickness of the medium, generally at least about ten or at least about one-hundred fold greater. The sheet medium may be planar and/or rolled (e.g., for storage) and/or may be provided as individual sheets, among others. Furthermore, the sheet medium may be flexible or stiff. The medium may have any suitable length, width, and area, generally according to the dimensions and handling capability of an apparatus used for activation (such as a printer or plotter, among others). For example, the sheet medium may have a length and/or width of at least about 10, 25, or 50 cm, and an area of at least about 100 $cm^2$ or 1,000 $cm^2$. In some examples, the medium may be generated by cutting a sheet from a media supply (such as a media roll or strip) before or after activation of the medium. The media supply may have a length that is substantially greater than the length and/or width of the medium, such as a length of at least about 1, 2, or 10 meters, among others. The medium also may have any suitable thickness, for example, to facilitate handling, activation, and/or printing. The thickness may be constant over the area of the medium or may vary, for example, near a perimeter and/at internal positions of the medium. The medium may have any suitable shape, such as polygonal (e.g., a quadrilateral (such as a rectangle), triangular, hexagonal, etc.), circular, oval, curvilinear, stellate, irregular, and/or the like.

Figure 3:
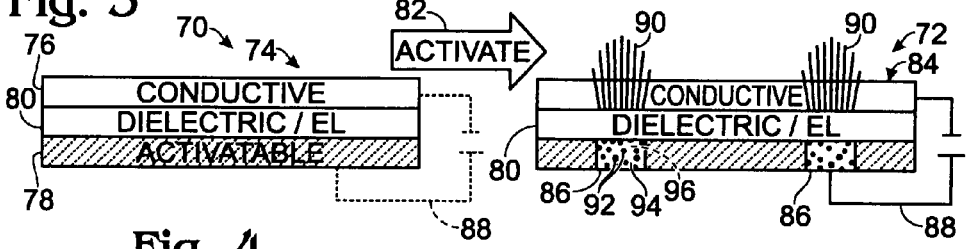
FIG. 3 is a schematic sectional view of another exemplary flowchart illustrating creation of an electroluminescent display from a blank medium, in accordance with aspects of the present teachings.

FIG. 3 shows another exemplary flowchart 70 illustrating creation of another exemplary electroluminescent display 72 from a blank medium 74. Medium 74 may include an assembly or stack of layers including an electrically conductive layer 76, an electrically nonconductive, activatable layer 78, and a dielectric and electroluminescent ("EL") layer or set of layers 80 disposed between the conductive and nonconductive layers.

This assembly of layers, before activation, may be termed a partial or inactive electroluminescent assembly because the assembly lacks a pair of flanking electrodes to generate an electric field in the electroluminescent layer. In particular, conductive layer 76 can function as a first electrode, but nonconductive layer 78 may be an activatable layer that is inactive as a second electrode(s) until altered by activation, indicated by an activation arrow 82, to create an activated medium 84. Activation may create a second electrode or set of spaced second electrodes 86 within the activatable layer, such that energization of the assembly with an electrical power source 88 causes electroluminescent layer 80 to emit light 90 by electroluminescence regionally from positions disposed between the first and second electrode(s).

The electrically conductive layer may have any suitable property, size, and composition. The term "conductive" (without a modifier (such as "non-," "less," or "more")), as used herein for describing a structure or material, signifies an ability to conduct electricity efficiently enough to serve as an electrode in an electroluminescent assembly. A conductive layer thus may be an electrical conductor and/or semiconductor, as appropriate. The conductive layer may have any suitable resistivity, such as a sheet or surface resistivity of less than about $10^3$ or 10 ohms/square and/or a volume or bulk resistivity of less than about 1 ohm-cm per square or less than about $3\times10^{-3}$ ohm-cm per square. The conductive layer, if disposed forward of (and/or behind) an electroluminescent layer in an electroluminescent display, may be light transmissive, i.e., at least substantially transparent, so that a majority of the emitted light that reaches the conductive layer from the electroluminescent layer can pass through the conductive layer for viewing external to the display. The conductive layer thus may have a thickness selected to facilitate light transmission. The conductive layer may be formed of a conductive material with suitable optical properties, such as an inorganic material (e.g., indium tin oxide (ITO), antimony tin oxide (ATO), etc.) and/or an organic material such as a suitable polymer/plastic (e.g., poly(3,4-ethylenedioxythiophene) or PEDOT).

The activatable layer may be configured to be activated selectively (regionally) from a relatively less to a relatively more conductive form. Any increase in electrical conductivity to promote light emission from the electroluminescent layer in response to electrical energization may be suitable, for example, an increase in electrical conductivity of at least about $10^3$-, $10^6$-, $10^9$-fold, among others. The activatable layer, in its relatively less conductive form, is generally nonconductive. The term "nonconductive," as used herein to describe a structure or material, signifies an inability to conduct electricity efficiently enough for the structure or material to serve as an electrode in an electroluminescent assembly. Nonconductive materials/structures may include insulators (dielectric materials/layers) and/or semi-insulators. A nonconductive material/layer may have any suitable resistivity before activation, for example, a sheet or surface resistivity of at least about $10^8$ or $10^{10}$ ohms/square and/or a volume or bulk resistivity of at least about $10^4$ or $10^6$ ohm-cm/square. With activation, the activatable layer may be modified regionally to a conductive form, as defined above.

The activatable layer may be a solidified layer and may include activatable elements 92, a binder 94, and/or a radiation absorber 96, among others.

The activatable elements may include any substance(s) or material that can be activated from a nonconductive to a conductive configuration. Activation may occur, for example, by changing the structure of the activatable elements themselves and/or their arrangement/spacing within the activatable layer. In some examples, the activatable elements may include a metal, such as elemental metal, a metal salt, and/or a metal complex. The activatable elements thus may include metallic particles, metal ions, coordinated metals, and/or the like. In some examples, the activatable elements may comprise conductive particles (such as nanoparticles) formed of metal (e.g., gold, silver, copper, aluminum, etc.), carbon, and/or the like. Activation thus may change the arrangement and/or concentration of conductive particles within the activatable layer, for example, to decrease or eliminate the spacing between conductive particles. Alternatively, or in addition, activation may change the chemical structure of the activatable elements, such as by reduction, rearrangement, and/or decomposition of metal salts and/or metal complexes to form metallic particles. Alternatively, or in addition, activation may change the physical structure of conductive particles such as by changing their shape and/or by fusing or sintering conductive particles.

The binder generally comprises any solidifiable material configured to hold the activatable elements and/or a radiation absorber. The binder thus may be a polymer, such as a thermoplastic elastomer. For example, the binder may be a polyurethane ether, a polyolefin, a polyether, and/or the like. In some examples, the binder may be ablatable, such as through decomposition, by exposure to electromagnetic radiation (optically ablatable) and/or heat (thermally ablatable). Accordingly, the binder may be at least partially removed or altered regionally by selective irradiation and/or heating. If optically and/or thermally ablatable, the binder may have a low char ratio such that decomposition produces mostly volatile gas.

The radiation absorber may be any substance that increases the absorption of electromagnetic radiation regionally within the medium. Generally, the radiation absorber selectively absorbs electromagnetic radiation of a particular wavelength or range of wavelengths, such that the radiation absorber functions as an "antenna" for radiation of that wavelength or wavelength range. The radiation absorber also may release the absorbed radiation as heat, to promote heating the medium regionally across the medium and/or through the medium, i.e., selectively within a subset of one or more layers of the medium and selectively across the layer subset. In some examples, the activatable layer may absorb activation energy/radiation at a faster rate compared to other layers that lack the radiation absorber, such that the activatable layer can be heated selectively. The radiation absorber thus may be dispersed in the activatable layer or in an adjacent layer, among others. The radiation absorber may be configured to enhance absorption of a predefined wavelength or range of wavelengths of electromagnetic radiation that corresponds to the wavelengths or wavelength range of electromagnetic radiation emitted by an activation source. For example, the radiation absorber may be configured to enhance absorption over the range of wavelengths emitted by an activating light source, such as an infrared laser, to promote heating of the medium regionally within the activatable layer. Heating may cause regional activation by converting the activatable layer to a more conductive form, such as by chemical reaction, binder ablation, binder liquefaction, decomposition of the radiation absorber, and/or the like. An activation source of relatively lower power may be suitable with a corresponding radiation absorber. For example, in some embodiments, regions within the activatable layer may be configured to be irradiated from a non-conductive form to a conductive form with a laser having a power of less than or equal to about 100 or 50 milliwatts.

In some embodiments, the radiation absorber may be configured to absorb infrared light having a wavelength of less than or equal to about 800 nanometers. Use of such an absorber may allow activation with lasers that emit light at 780 nm, which are sometimes found in compact disk write devices and digital video disc (DVD) write devices. Such low power lasers may be relatively inexpensive as compared to higher powered lasers. Examples of radiation absorbers with strong absorption at about 780 nm include Avecia Pro-Jet 800 N.P. commercially available from Avecia, silicon naphthalocyanine, indoyanine green, IR780 iodide commercially available from Aldrich Chemicals and assigned CAS No. 207399-07-3, American Dye Source (ADS) 780 PP laser dye which is assigned CAS No. 206274-50-2, s0322 commercially available from FEW Chemicals and having CAS No. 256520-09-9, and/or the like.

Further aspects of activatable layers and activation of activatable layers are described below, such as in the examples of Section II.

The electroluminescent layer may include any suitable electroluminescent material. An electroluminescent material, as used herein, is any substance or mixture that emits light by electroluminescence when placed in a suitable electric field, particularly an alternating electric field generated by an alternating current (an AC power supply). Exemplary electroluminescent materials may be phosphors including various metals, such as zinc, copper, manganese, selenium, strontium, europium, cerium, other rare earth metals, etc. Electroluminescent materials may emit light via fluorescence and/or phosphorescence. The emitted light may have any suitable wavelength or range of wavelengths, so that the light appears white, red, blue, green, etc.

The electroluminescent layer may be included in and/or disposed adjacent one or more dielectric layers. A dielectric layer or material, as used herein, is substantially insulating to the flow of electricity relative to the conductive layer(s) of an electroluminescent assembly. A dielectric layer may have any suitable resistivity, such as a resistivity of at least about $10^8$ or $10^{10}$ ohms/square and/or a volume or bulk resistivity of at least about $10^4$ or $10^6$ ohm-cm/square. The dielectric layer may have a thickness selected to allow formation of a sufficient field strength between the conductive layer and activated regions of the activatable layer. Accordingly, in some embodiments, the dielectric layer may be about 1-100 μm, 5-50 μm, 10-30 μm, or nominally about 20 μm, among others. The dielectric layer may be one or more layers. In some examples, the dielectric layer includes the electroluminescent material or is a distinct layer adjacent an electroluminescent material, to avoid dilution of the electroluminescent material. If formed as a layer(s) distinct from the electroluminescent layer, the dielectric layer(s) may be disposed between the activatable layer and the electroluminescent layer, between the electroluminescent layer and the conductive layer, or both. In some examples, the dielectric layer, the activatable layer, and/or another layer disposed rearward of the electroluminescent layer may be reflective to increase the amount of emitted light that is reflected toward the front of the electroluminescent display.

Figure 4:
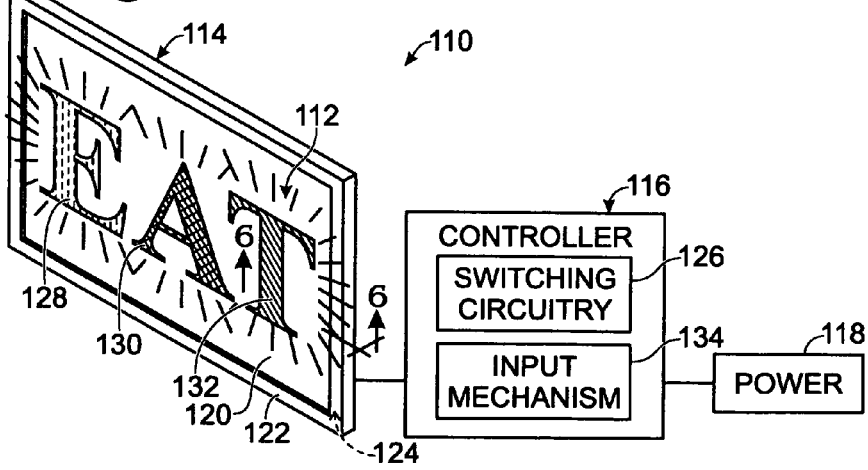
FIG. 4 is a somewhat schematic view of an exemplary electroluminescent display system created by activation of a blank medium to produce an activated medium, in accordance with aspects of the present teachings.

FIG. 4 shows an exemplary electroluminescent display system 110 created by activation of a blank medium to produce a luminescent image 112 ("EAT" in the present illustration). The system may include a display 114, a controller 116, and a power supply 118.

The display may include an activated medium 120 and a frame 122. The activated medium may be created by activation of a blank medium before (or after) the activated (or blank) medium is disposed in the frame. Frame 122 may provide mechanical stability for the medium. Accordingly, the frame may extend around the perimeter of the medium and/or across the back of the medium. The frame also or alternatively may provide a mounting capability and/or electrical contact structure 124 (such as contact pads, wires, pins, sockets, etc.), among others, for the display.

Controller 116 may be coupled to the display to control power input from power supply 118 to the display and particularly to electrodes of the display. The controller thus may include switching circuitry 126 that controls when and how the luminescent display is produced. For example, the switching circuitry may control when image components 128, 130, 132 (in the present illustration, regions corresponding to the letters "E," "A," and "T") are lit relative to one another, to provide, for example, animation of image components within the image, such that the image components are visible sequentially and/or in varying combinations. (For example, in the present illustration, the individual letters of the word "EAT" may be produced by light emission sequentially or concurrently in any suitable combination.) The switching circuitry also or alternatively may control when the display is active (e.g., within a 24-hour or weekly period) and/or the luminescence intensity over time (e.g., to produce luminescence that brightens or dims in a stepwise and/or gradual fashion when viewed). The controller thus may have an input mechanism, such as user interface 134, through which a user may input preferences about how the display is to be controlled.

Figure 5:
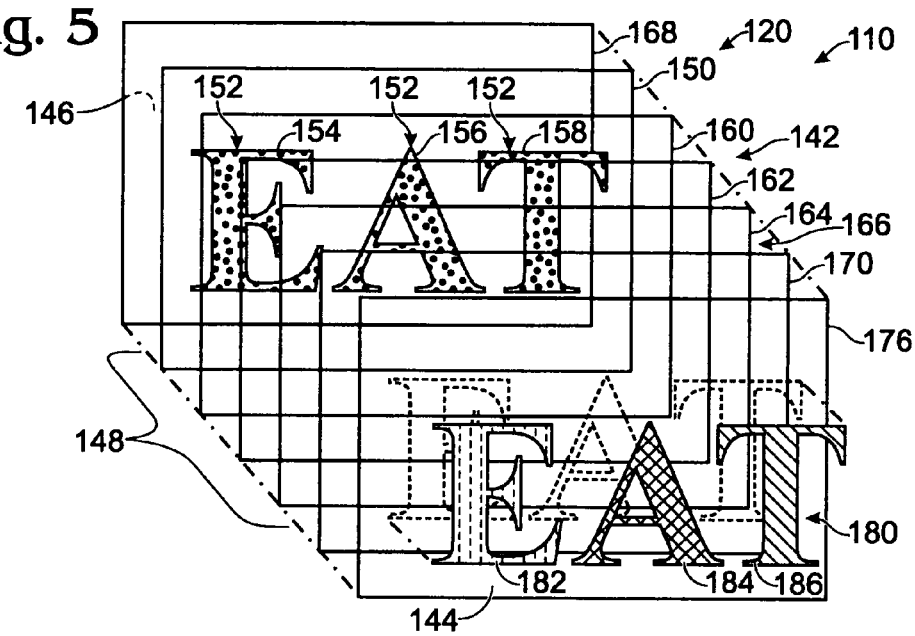
FIG. 5 is an exploded view of the activated medium of FIG. 4, in accordance with aspects of the present teachings.
Figure 6:
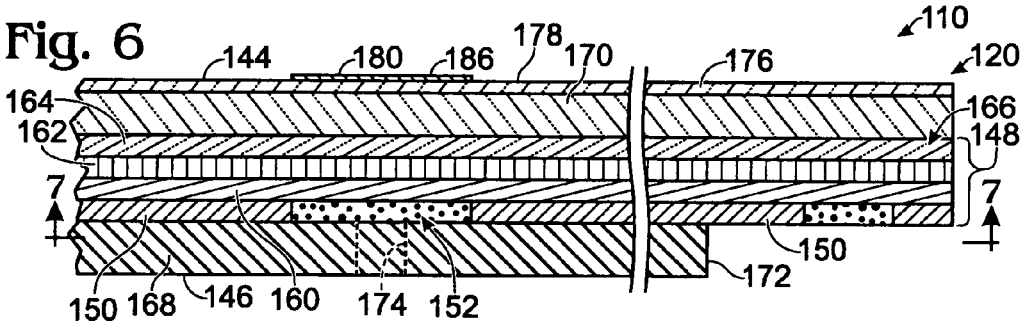
FIG. 6 is a sectional view of the activated medium of FIG. 4, taken generally along line 6-6 of FIG. 4 in the absence of the frame, in accordance with aspects of the present teachings.

FIGS. 5 and 6 show activated medium 120 of system 110 in exploded and assembled configurations, respectively. Activated medium 120 may include a plurality of layers 142 that are assembled into an integrated medium in which the layers are attached to one another in a face-to-face arrangement. The layers may be configured such that the medium emits light from a front face 144 of the medium, from a back face 146 of the medium, or both. Layers 142 may include an electroluminescent stack 148 that can be electrically energized to emit a luminescent image. Stack 148 may include a regionally activated layer 150 with activated regions 152 corresponding to discrete rear electrodes 154, 156, 158. Stack 148 also may include a dielectric layer 160, an electroluminescent layer 162, and a conductive layer 164 forming front electrode 166.

The electroluminescent stack may be substantially interior to the activated medium. In particular, the stack may be flanked by one or more exterior (or relatively more exterior) cover layers including a rear cover layer 168 and/or a front cover layer 170. Each cover layer may be included in the medium before or after activation and may be formed as part of the medium, attached after formation, and/or may provide a substrate layer on which one or more other layers of the medium are formed and/or onto which other layers are assembled. In some examples, one or both cover layers may be dielectric, to insulate the electroluminescent stack and/or to ensure that rear electrodes 154-158 remain electrically isolated from one another (if appropriate). A cover layer may have a thickness that is less than, about the same as, or greater than the thickness of the layers of the electroluminescent stack. In some examples, the cover layer(s) may have a thickness of at least about 0.05 or 0.1 mm, among others. The cover layer may be transmissive (and/or transparent) to the activation energy (e.g., to the wavelength of light used for activation) and/or to visible light. Alternatively, the cover layer may be opaque to the activation energy and/or visible light, for example, if activation and/or light emission occurs through the opposing side of the medium and/or if the cover layer is added after activation. The cover layer thus may be formed of any suitable material, such as a polymer and/or plastic. Exemplary cover layers may include polyethylene terephthalate (PET), polyvinylchloride (PVC), polyethylene (PE), and/or the like.

The rear cover layer (or layers) may have any suitable properties. For example, the rear cover layer may be thicker than one or more (or all layers) of the electroluminescent stack. A thicker layer may, for example, increase the mechanical stability of the medium and/or may allow the rear cover layer to be formed as a separate layer that is attached to the medium after formation of the rear cover layer. The rear cover layer may be substantially transparent to visible light and/or activating light, for example, to allow visual inspection of the activatable layer before and after activation (such as to view a visible change in the activatable layer produced by activation) and/or to facilitate irradiation of the activatable layer through the rear cover layer. Alternatively, the rear cover layer may be substantially opaque, for example, to facilitate reflection of emitted light toward the front of the display.

The rear cover layer may extend over any suitable portion (or all) of the medium. In some examples, the rear cover layer may define a perimeter opening(s) 172 or a non-perimeter opening(s) 174 of the medium (see FIG. 6). The perimeter opening may extend along a portion of all of one or more sides of the medium. Each opening may be disposed such that one or more activated regions 152 (or a conductive extension thereof) can be accessed electrically through the opening. Accordingly, the opening(s) may be formed after activation of the medium, according to the position(s) of the activated region(s), and/or each activated region may be formed to extend to an opening(s).

The front cover layer may have any suitable properties. For example, the front cover layer may be at least substantially transparent to permit emitted light to travel out of the medium. The front cover layer also may be transmissive for activating radiation, such that the activatable layer can be activated by illumination from the front side of the medium. The front cover layer also or alternatively may provide mechanical stability.

The medium further may include a print-receptive layer or coating 176. Layer 176 may provide an exterior print-receptive surface 178. The print-receptive layer may be formed by the front cover layer or may be an additional layer disposed on the front cover layer, among others. In any case, the print receptive surface may be configured to receive a colorant(s) (such as ink, another fluid colorant(s), and/or a solid colorant(s)) applied to the surface, such that the colorant is retained below and/or on the surface to form an optical layer 180. The colorant(s) may be applied with any suitable printing device, such as an inkjet printer, a laser printer, a print screen, and/or the like. A suitable print-receptive layer may be provided by HP COLORLUCENT Backlit Film, available from Hewlett-Packard.

Each colorant may provide any suitable optical property after application. For example, the optical layer, via the colorant(s), may act as (1) a spectral filter, to alter the spectrum (and thus the color) of emitted light, (2) an intensity filter, to reduce the intensity of emitted light (or to block the light), (3) a photoluminescent layer excited by emission from the electroluminescent layer, (4) a refractive layer, (5) a polarizing layer, (6) a dispersive layer, (7) a diffractive layer, (8) a scattering layer, and/or the like. In the present illustration, optical or colorant layer 180 is formed by a purple colorant region 182 ("E"), an orange colorant region 184 ("A"), and a green colorant region 186 ("T") (see FIG. 5).

Figure 7:
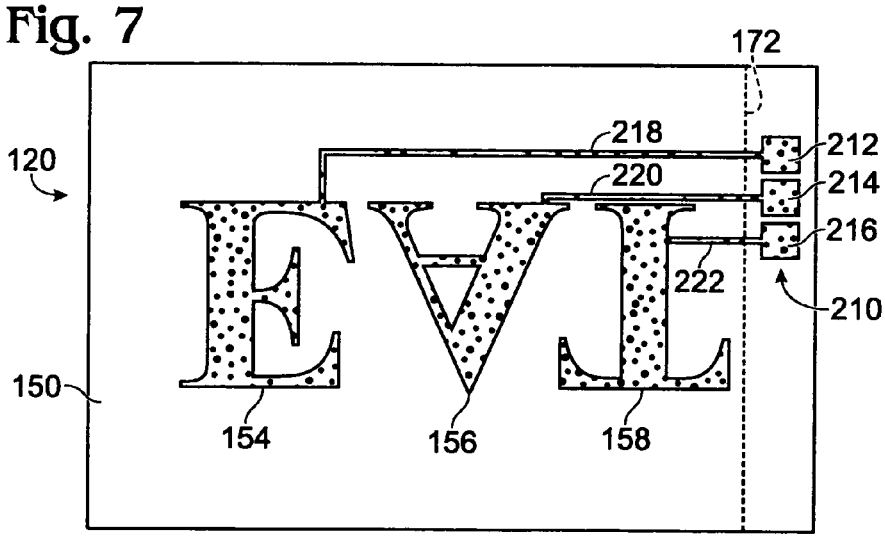
FIG. 7 is a view of the activated medium of FIG. 6, taken generally along line 7-7 of FIG. 6, in accordance with aspects of the present teachings.

FIG. 7 shows activated medium 120 viewed from behind the medium with rear cover layer 168 removed (see FIGS. 5 and 6). Each electrode 154, 156, 158 may include a respective electrical coupling structure 210, such as contact pads 212, 214, and 216, disposed adjacent the perimeter of the medium. The contact pads (or other coupling structure) may be accessible through opening 172, to facilitate coupling the controller (and/or power supply) of the display system individually to each of the electrodes. In some embodiments, the contact pads may be disposed for engagement with the frame of the display system (see FIG. 4), such that the frame electrically couples to the contact pads when the frame receives the activated medium. The contact pads thus may be formed during fabrication of the blank medium (before custom activation) and/or may be formed during custom activation of the medium. In any case, the contact pads may be disposed at predefined positions within the medium or may be disposed at arbitrary positions for manual coupling with the controller and power supply. The contact pads may be conductively coupled to the body of electrodes 154-158 via conductive traces 218, 220, and 222 respectively. The conductive traces also may be formed in a custom pattern during activation of the medium or may be formed in a predefined arrangement during fabrication of the medium. The traces may be narrow enough that they do not cause substantial light emission from positions in the electroluminescent layer adjacent the traces when electrically energized and/or the optical layer may be formed to block light emission corresponding to the traces, among others.

Figure 8:
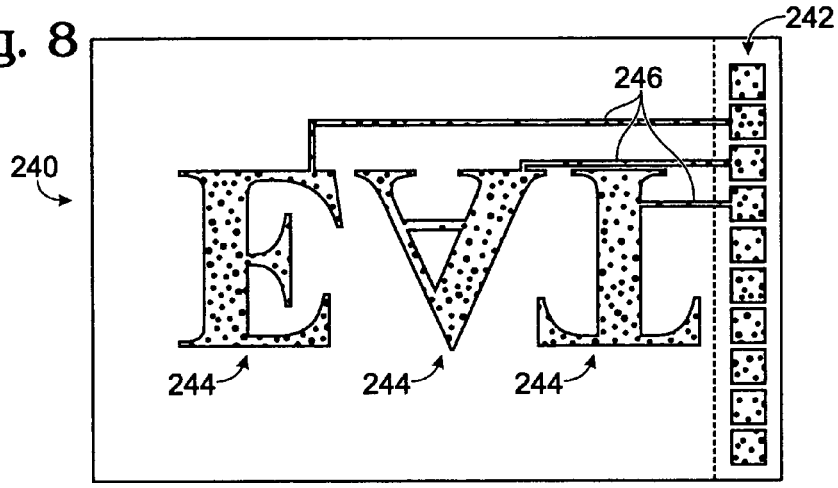
FIG. 8 is a view of another exemplary activated medium, taken generally as in FIG. 6, in accordance with aspects of the present teachings.

FIG. 8 shows another embodiment of an activated medium 240, viewed generally as in FIG. 7. Medium 240 may include a plurality of preformed electrical contact structures 242 introduced into the medium during its fabrication (before custom activation). Accordingly, medium 240 may be installed in a frame that includes corresponding electrical contact members for each of contact structures 242. Any suitable subset (or all) of contact structures 242 may be coupled to custom electrodes 244, formed during custom activation, via traces 246 also formed during custom activation.

Figure 9:
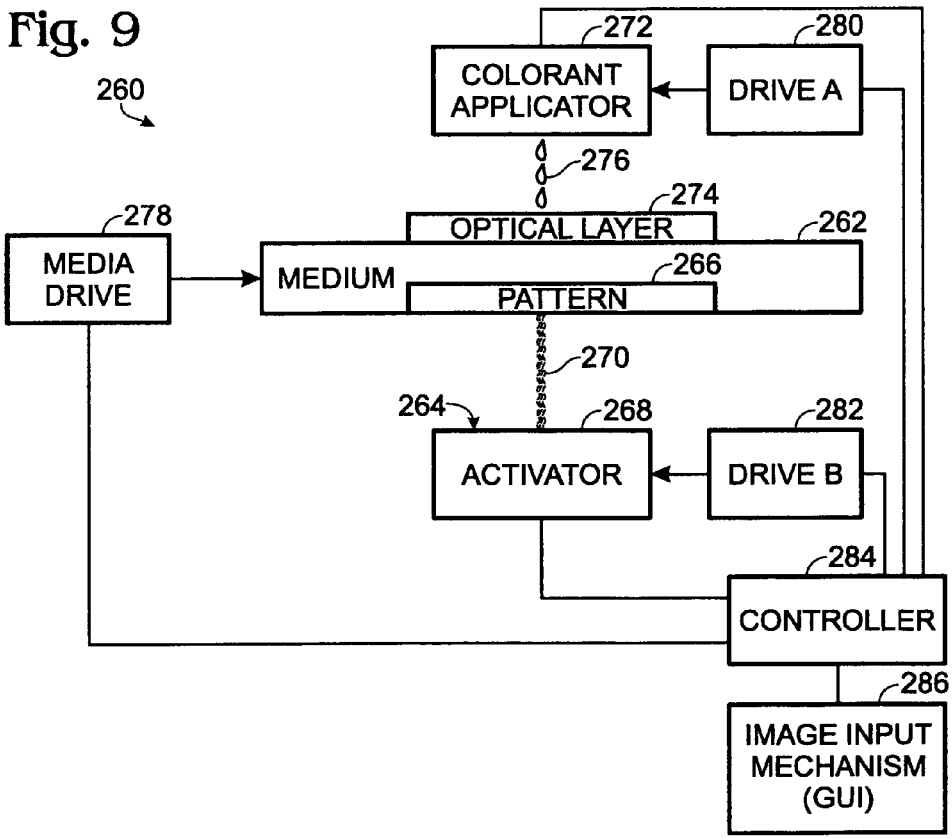
FIG. 9 is a schematic view of an exemplary apparatus for activating a medium to create an electroluminescent display, with the apparatus in the process of activating a medium in a pattern and applying a colorant to an exterior surface of the medium, in accordance with aspects of the present teachings.

FIG. 9 shows an exemplary apparatus 260 for activating a medium 262 to create an electroluminescent display. Apparatus 260 may include an activator 264 to activate medium 262 in a pattern 266. The activator may be, for example, a light source or laser 268 that produces light 270 (e.g., infrared light). The apparatus also may include a colorant applicator 272 to form an optical layer 274 on and/or in the medium by selective delivery of colorant(s) 276 to the medium. The apparatus further may include a media drive 278 to move the medium relative to the activator and/or colorant applicator and/or additional drives 280, 282 to move the activator and colorant applicator, respectively. Apparatus 260 may be manufactured with both the colorant applicator and activator, or the activator may be an after-market add-on installed in an inkjet printing device or laser printing device, among others.

Apparatus 260 also may include a controller 284 that controls and coordinates operation of the activator and colorant applicator (and their associated drives 280, 282), and the media drive, among others. The controller thus may control when and where the activator activates the medium (e.g., illuminates the medium with light). The controller also may control when, where, how much, and which type(s) of colorant are applied to the medium. The controller may be coupled to an image input mechanism 286, such as a graphical user interface, through which a user may input information (such as image data) about the display to be created by the apparatus. In some embodiments, the graphical user interface may present to the user a representation of the display to be produced based on the inputted information from the user. The representation may be updated as the user edits the inputted information.

The activator and colorant applicator may have any suitable disposition within the apparatus and may be used at any suitable relative times. The activator and colorant applicator may be disposed on the same side of the medium (adjacent the front or back of the medium), or on opposing sides of the medium, as in the present illustration. In any case, the activator and colorant applicator may be coupled to one another for coupled movement, for example, propelled by the same drive, and/or may move independently. The activator and the colorant applicator may be operated concurrently, so that activation of the medium and printing (application of colorant(s)) occur at overlapping times. Alternatively, activation and colorant application may be performed sequentially, with activation being performed before or after colorant application. If performed sequentially, the medium may be retracted automatically by the media drive after activation (or colorant application) for subsequent colorant application (or activation) or may be reloaded manually into the same or a different apparatus. If reloaded manually, the medium may be reloaded in the same or a different orientation (e.g., flipped over). Alternatively, the medium may travel automatically through an activation station and then a colorant application station disposed downstream (or upstream) of the activation station, so that the medium travels forward only. In some embodiments, positional registration of activation and colorant application may be facilitated by registration indicia on the medium that can be sensed by the apparatus. The registration indicia may be formed on the medium during fabrication by the manufacturer, during activation, and/or during colorant application, among others.

Laser irradiation of the medium may be performed by raster scanning across a region to be activated. For example, the laser may irradiate the medium to create an array of spaced lines of irradiation in the medium. The lines of irradiation may be positioned sufficiently close to one another such that the activated region exhibits electrical conductivity between the lines. As a result, substantially the entire area of the activated region may be electrically conductive. In exemplary embodiments, lines of laser irradiation may be spaced less than or equal to about 25 microns from one another, or nominally by about 18 microns, among others.

Figure 10:
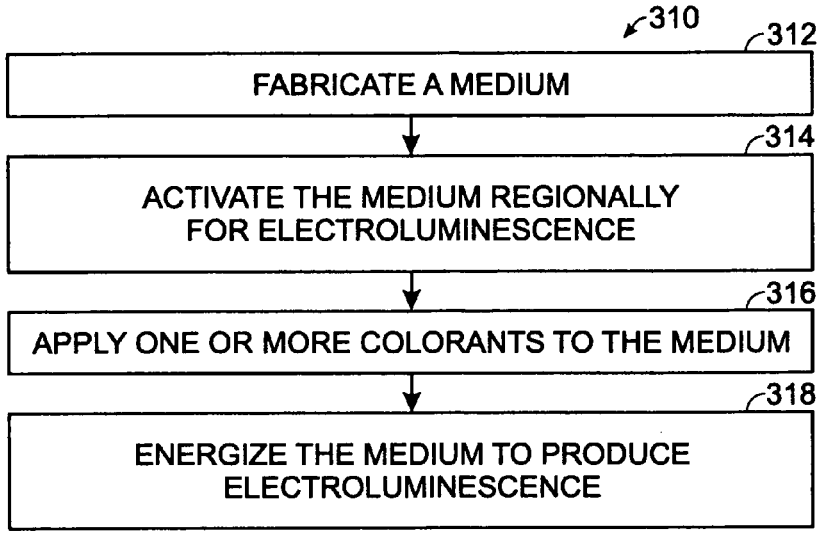
FIG. 10 is a schematic view of an exemplary flowchart for a method of creating an electroluminescent display, in accordance with aspects of the present teachings.

FIG. 10 shows an exemplary flowchart 310 for creation of an electroluminescent display according to an exemplary method of the present teachings. The operations shown may be performed any suitable number of times, in any suitable order, and in any suitable combination.

A medium may be fabricated, shown at 312. Fabrication may be performed by a manufacturer(s) and may involve obtaining a substrate layer and forming layers on and/or attaching layers to the substrate layer. Forming layers on the substrate layer, as used herein, means that the layers are created in close association with the substrate layer, either in direct contact with the substrate layer or separated from the substrate layer by one or more other layers attached to the substrate layer. Each layer may be formed by any suitable technique, including spin coating, dip coating, doctor blading, screen printing, spraying, etc. After application of each layer material, generally in an unsolidified form, the layer may be solidified by any suitable technique, including chemical polymerization, curing by light (such as UV-curing), solvent evaporation, heating, and/or the like. Layers may be attached to the substrate layer, i.e, laminated to the substrate, using any suitable adhesive and/or by bonding, either directly to the substrate layer and/or directly to a layer attached directly or indirectly to the substrate layer. The layers may be formed on and/or attached to the substrate layer on only one side of the substrate layer and/or on opposing sides of the substrate layer. The fabricated medium may include an activatable electroluminescent assembly (e.g., a stack including a nonconductive activatable layer, one or more dielectric layers, an electroluminescent layer, and a conductive layer). The fabricated medium also may include an assembly of joined layers, that is, layers affixed to one another, including a front cover layer(s) and/or a back cover layer(s) and a print-receptive layer and/or exterior surface. Alternatively, the medium may be fabricated such that one or more of these layers or surfaces are not present. In any case, the medium may have an integrated structure in which the layers are substantially inseparable.

The medium may be activated regionally for electroluminescence, shown at 314. The medium may be custom-activated in a pattern according to an electroluminescent image to be created when the medium is energized electrically. Activation converts a substantially inactive electroluminescent assembly into a regionally active assembly by altering one or more of the layers of the assembly. A generic activation also may be performed by the manufacturer prior to custom activation, for example, to introduce a border, a logo of the manufacturer, electrical contact structures, conductive traces, and/or the like.

One or more colorants may be applied to the medium, shown at 316. The colorants may be applied to an external surface, generally one of the opposing faces of the medium, before, during, and/or after the medium is custom activated. The colorants, or a subset thereof, may be applied based on the pattern of activation for the medium, such that the colorants at least partially overlap with the regions of activation. Accordingly, at these positions of colorant application, an aspect of the emitted light, such as its spectrum (color) and/or intensity, among others, may be modified. For example, at least a subset of the colorants may be applied at positions such that the colorants are generally aligned with portions (or all) of the activation pattern. However, in some examples, the colorants also or alternatively may be applied at positions over non-activated regions of the medium, so that the colorants are not back-lit at these positions, and/or may not fully cover regions of luminescence (e.g., such that the color and/or intensity of electroluminescence is not altered at these positions).

The medium may be energized electrically to produce electroluminescence generally in the pattern defined by activation, shown at 318. Energization may be performed by providing electrical coupling between the activated medium and a power supply, such as by installing the activated medium in a frame coupled to a power supply. Energization may cause light emission for different portions of the pattern simultaneously, sequentially, and/or combinatorially.

Figure 11:
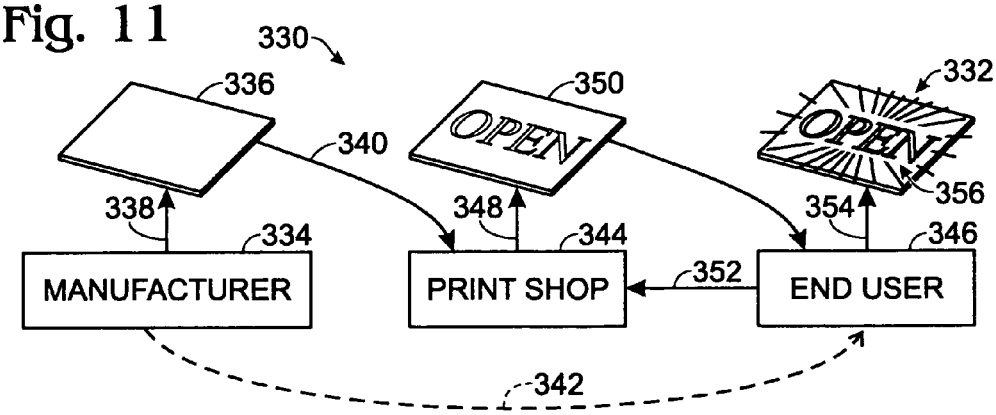
FIG. 11 is a schematic view of an exemplary flowchart illustrating exemplary roles of various parties for creation of an electroluminescent display, in accordance with aspects of the present teachings.

FIG. 11 shows an exemplary flowchart 330 illustrating exemplary roles played by different parties during creation of an electroluminescent display 332 according to a method of the present teachings. A manufacturer 334 may fabricate a blank medium 336, indicated at 338. The blank medium may be introduced into a stream of commerce, shown at 340 and 342, for commercial acquisition (generally, purchase) by another party, such as a print shop 344 and/or an end user 346 of the display. Introduction of an item into a stream of commerce, as user herein, means that the item is offered for sale or trade, is sold or traded, and/or is transferred directly or indirectly to a distributor that offers the item for sale or trade and/or sells or trades the item. The blank medium may be activated (and, optionally, a colorant(s) applied to the medium), indicated at 348, by the print shop and/or end user to create an activated medium 350. A print shop, as used herein, is any commercial entity of one or more people (a business) that adds custom content to media commercially for clients (individuals or companies) based on input about the custom content from the clients. Accordingly, if activated by the print shop, the print shop may receive image information, indicated at 352, about the desired content of the display from the end user, generally a client of the print shop. The print shop thus may create a customized display for the client based on the image information supplied by the client. Alternatively, the end user may activate (and, optionally apply a colorant(s)) to the medium without assistance from a print shop, shown at 342. In any case, the end user may energize the activated medium, indicated at 354, to create a luminescent image 356 using the customized display.

Figure 12:
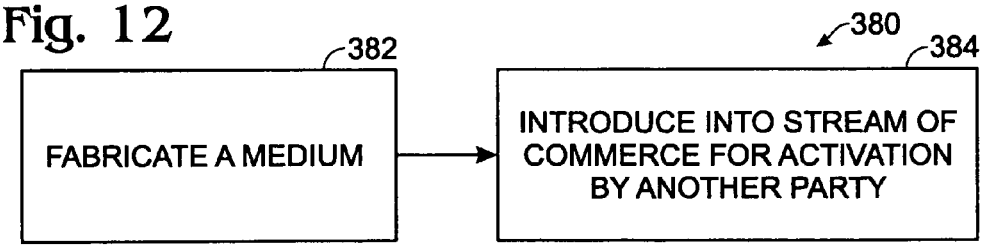
FIG. 12 is a schematic view of an exemplary flowchart showing exemplary operations performed by a manufacturer during creation of an electroluminescent display, in accordance with aspects of the present teachings.

FIG. 12 shows an exemplary flowchart 380 for operations performed by a manufacturer during creation of an electroluminescent display according to a method of the present teachings. A medium (or media) may be fabricated by the manufacturer, shown at 382. The manufacturer may represent a single business entity or a set of business entities that perform different aspects of the fabrication. The manufacturer may introduce the medium (or media) into a stream of the commerce for activation by another party, shown at 384. Accordingly, the other party may introduce custom luminescent content into the medium. The medium may be introduced into the commerce stream as a blank. The other party, such as a print shop or end user, may acquire the medium from the commerce stream, that is, directly from the manufacturer or from an intermediate party that acquired the medium directly or indirectly from the manufacturer.

Figure 13:
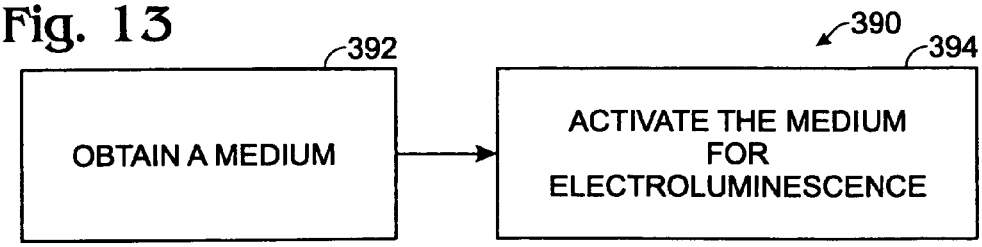
FIG. 13 is a schematic view of an exemplary flowchart showing exemplary operations performed by one or more other parties downstream of medium manufacture during creation of an electroluminescent display, in accordance with aspects of the present teachings.

FIG. 13 shows an exemplary flowchart 390 for operations performed by one or more other parties, such as a print shop and/or end user, downstream of the manufacturer during creation of an electroluminescent display according to a method of the present teachings. A medium may be obtained, shown at 392. The medium may be acquired from a commerce stream, that is, directly or indirectly from the manufacturer. The medium may be activated for electroluminescence upon energization, shown at 394. Activation may introduce custom content into the medium based on image data provided by the print shop and/or end user.

II. EXAMPLES

The following examples describe selected aspects and embodiments of the present teachings, including exemplary activatable layers and methods of activating the activatable layers. These examples are included for illustration and are not intended to limit or define the entire scope of the present teachings. All percentages and parts are by weight unless otherwise noted.

Example 1

This exemplary describes preparation and use of an exemplary activatable layer that includes silver tetraglyme.

A composition to form an activatable layer is presented in Table 1.

TABLE 1

Materials for fabricating an exemplary activatable layer

| Material | Weight Percent | Supplier |
|---|---|---|
| Silver tetraglyme | 47% | Silver tetraglyme made according to literature prep (Inorg. Chem. 37, (1998), 549). |
| Alloy: cirrus 715 and m-terphenyl | 3.66% | 715: Avecia m-terphenyl: Aldrich (the two are melted together into an alloy) |
| 381-20 (cellulose acetate butyrate) | 4.9% | Eastman |
| Paraloid B60 | 4.9% | Rohm and Haas |
| Ethyl acetate | 39.5% | Aldrich |

The composition listed in Table 1 was prepared and applied to a polycarbonate disk as a coating. The coating was then heated creating a series of colors. Continued heating caused the coating to develop a reddish black coloration.

The composition was applied to another polycarbonate disk and dried. The dried coating was irradiated with a 55 milliwatt laser moving at a linear velocity of 0.1 meters per second having a density of 1000 lines or tracks per inch. Upon being irradiated and heated, the coating attained a silver coloration indicative of a conductive track.

Example 2

This example describes preparation and use of an exemplary activatable layer that includes a conductive paste diluted with a radiation absorber (a dye).

Table 2 lists ingredients used to prepare an activatable composition.

TABLE 2

Exemplary activatable composition

| Material | Supplier |
|---|---|
| ADS 780 PP Dye | American Dye Source |
| ELECTRODAG ® PF-007 (Ag conductor, thermoplastic binder) | Acheson |

The dye was incorporated into the paste by use of a 3-roll mill forcing the paste through an inturning nip of rubber rollers incorporating the dye into the matrix of the paste. Compositions having greater than 8% dye were thinned using butyl carbitol acetate to facilitate screen printing. The compositions were screen printed using a 390 mesh, 45 degree pitch, 2 micron emulsion screen. The substrate comprised either a blank polycarbonate disk or polyethylene terephthalate (PET) film. Films on the disk were dried in a 70° C. oven for at least 30 minutes. Coatings were irradiated with a laser at a height of 0.088 inches over the surface of the coating. The laser comprises a 780 nanometer laser run at 35 milliwatts of power and continuously rastered or moved at a speed of 1 inch per second. In other embodiments, the speed may be varied.

The resultant sheet resistivity as a function of the percent of dye was measured for the coating of this example. The coating exhibited a decline in conductivity (i.e., an increase in resistivity) beginning with the addition of about 2% of the ADS 780 PP dye. Those portions of the coating that were irradiated exhibited a change in color. In the present example, the coating exhibited a change in color from green to brown. Coatings having between about 4% dye to about 16% dye may be altered to an electrically conductive form upon being radiated. In particular, the resistivity of the brown exposed coating is between about 0.1 to 2 ohm/square while the unexposed coating has a resistivity as high as 10 giga-ohm/square. With a thickness of 2.9 microns, the coating of this example has a bulk resistivity of about $3\times10^{-5}$ to $6\times10^{-4}$ ohm-cm per square after exposure to the laser while the bulk resistivity of the coating which has not been exposed to the laser is greater than 3 mega-ohm-centimeter per square once the dye concentration is between 10% and 18%.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A method of producing an electroluminescent display, comprising:

obtaining an activatable medium comprising a plurality of layers, at least one of the layers providing a first electrode;

activating the medium with electromagnetic radiation in a selected region to form at least one second electrode, such that the medium emits light by electroluminescence in response to electrical energization of the first electrode and the at least one second electrode; and applying one or more colorants to an external surface of the medium while activating the medium.

2. The method of claim 1, wherein activating the selected region of the medium further comprises altering a physical characteristic within the selected region of one or more of the plurality of layers.

3. The method of claim 1, wherein activating the medium further comprises altering intrinsic electrical conductivity within the selected region of at least one of the plurality of layers.

4. The method of claim 1, wherein activating the medium comprises exposing the medium to electromagnetic radiation regionally.

5. The method of claim 4, wherein activating the selected region of the medium comprises irradiation of the medium with infrared light.

6. The method of claim 1, wherein the plurality of layers comprises a pair of exterior layers and one or more interior layers disposed between the exterior layers, and wherein at least one interior layer comprises an activatable layer.

7. A method of producing an electroluminescent display, comprising:

obtaining a sheet medium comprising a plurality of layers, at least one of the layers providing a first electrode;

activating the sheet medium, in at least one interior layer, in a pattern with electromagnetic radiation to form at least one second electrode, such that the sheet medium emits light by electroluminescence according to the pattern in response to electrical energization of the first electrode and the at least one second electrode; and applying one or more colorants to an external surface of the medium while activating the medium.

8. The method of claim 7, wherein applying one or more colorants to the medium is based on the pattern such that at least a portion of the light emitted is altered by the one or more colorants.

9. A method of producing an electroluminescent display, comprising:

fabricating a medium including a first electrode and configured to be activated with electromagnetic radiation to form at least one second electrode in a pattern, such that the medium after activation emits light by electroluminescence according to the pattern in response to electrical energization of the first electrode and the at least one second electrode; and applying one or more colorants to an external surface of the medium during activation of the medium.

10. The method of claim 9, wherein the medium comprises a plurality of layers and fabricating a medium comprises configuring the medium to be activated to form at least one second electrode in a pattern by regional alteration of an intrinsic physical characteristic within one or more of the plurality of layers.

11. The method of claim 10, wherein the medium is configured to be activated by increasing electrical conductivity regionally within one or more of the plurality of layers.

12. The method of claim 9, wherein fabricating a medium comprises one or more interior layers configured to be modified by selective absorption of electromagnetic radiation.

13. The method of claim 9, wherein fabricating includes fabricating a medium including an electrically nonconductive layer alterable regionally to an electrically conductive form by heat.

14. The method of claim 13, wherein fabricating includes fabricating a medium including a plurality of layers, one or more of the plurality of layers being configured to absorb light selectively such that the material is heated.

15. The method of claim 9, wherein applying one or more colorants is performed by printing onto the medium.

16. The method of claim 9, wherein fabricating a medium includes fabricating a blank medium that emits at least substantially no light by electroluminescence in response to electrical energization before activation.

17. The method of claim 1, wherein activating includes sintering conductive particles in the medium.

18. The method of claim 1, wherein the medium includes a binder and activatable elements disposed in the binder, and wherein activating includes ablating the binder.

19. The method of claim 18, wherein the activatable elements are conductive particles.

20. The method of claim 19, wherein the conductive particles are metallic particles.

* * * * *